US006612254B1

(12) United States Patent
Arthur

(10) Patent No.: US 6,612,254 B1
(45) Date of Patent: Sep. 2, 2003

(54) TOWABLE UNDERWATER KITE

(76) Inventor: Brian Frank Arthur, PO Box 501, Townsville (AU), 4810

( * ) Notice: Subject to any disclaimer, the term of this patent is extended or adjusted under 35 U.S.C. 154(b) by 0 days.

(21) Appl. No.: 10/203,654

(22) PCT Filed: Nov. 7, 2000

(86) PCT No.: PCT/AU00/01366

§ 371 (c)(1),
(2), (4) Date: Aug. 27, 2002

(87) PCT Pub. No.: WO01/34461

PCT Pub. Date: May 17, 2001

(30) Foreign Application Priority Data

Nov. 8, 1999 (AU) ..... 58362/99

(51) Int. Cl.[7] ..... B63C 11/46
(52) U.S. Cl. ..... 114/315; 114/245; 114/253
(58) Field of Search ..... 114/245, 253, 114/312, 315, 332

(56) References Cited

U.S. PATENT DOCUMENTS

| | | | | |
|---|---|---|---|---|
| 2,843,860 A | | 7/1958 | Grootveld | 114/245 |
| 2,936,466 A | * | 5/1960 | Szymczyk et al. | 114/245 |
| 3,101,691 A | * | 8/1963 | Wendt | 114/245 |
| 3,255,723 A | * | 6/1966 | Teetor | 114/245 |
| 3,440,994 A | * | 4/1969 | McGowan | 440/15 |
| 3,638,598 A | * | 2/1972 | Vlad | 114/245 |
| 3,650,234 A | * | 3/1972 | Goudy | 114/315 |
| 3,931,777 A | | 1/1976 | Colgan | 114/245 |
| 4,149,483 A | * | 4/1979 | Scott, Jr. | 114/332 |
| 4,624,207 A | * | 11/1986 | King | 114/315 |
| 5,134,955 A | * | 8/1992 | Manfield | 114/332 |
| 5,178,090 A | * | 1/1993 | Carter | 114/315 |
| 6,033,276 A | * | 3/2000 | Han | 114/315 |
| 6,145,462 A | | 11/2000 | Aquino | 114/253 |

FOREIGN PATENT DOCUMENTS

| | | |
|---|---|---|
| AU | 270880 | 6/1964 |
| CA | 2239414 | 1/2000 |
| EP | 0 246 853 | 11/1987 |

* cited by examiner

*Primary Examiner*—S. Joseph Morano
*Assistant Examiner*—Lars A. Olson
(74) *Attorney, Agent, or Firm*—Hoffman, Wasson & Gitler, PC

(57) ABSTRACT

In a device for towing riders on or through the water it is known to have planar board(s) or wing(s). In this invention, there are two independently operated symmetrical wings hinged to wing supports. The fore mounted wing supports are secured to, and are perpendicular to, the longitudinal body of the craft which creates a front to rear axial line. The wings have hand hold openings through them at their trailing edge and are manually operated, up or down, by the slightly forward arms of a single prone rider who is aft of the wings. A belly board secured on top of the body of the craft and aft of wings, a knee brace perpendicular to the body of the craft and aft of the belly board, and a foot rest perpendicular to the body of the craft and aft of the knee brace; secures, and makes comfortable, the rider to the craft. The said craft, while being towed via fore mounted tow line connector, allows a single swimmer/diver/water sport enthusiast to dive, level-off, move laterally, move vertically, roll, and surface all with expending minimal energy due to exertion and all without, or with, an underwater breathing apparatus.

10 Claims, 2 Drawing Sheets

TOWABLE UNDERWATER KITE

FIELD OF THE INVENTION

This invention relates to a towable non-self-propelled, non-airtight underwater kite which can support a person and which can be towed behind a powered vessel at a comfortable speed and where the person can adjust the rise and fall of the kite.

BACKGROUND ART

Underwater towed dragged devices such as underwater kites are known and are towed behind a powered vessel such as a boat. These kites are equipped with fish finders, sonar, acoustic fathometers and the like. These known kites are not manned and function to collect scientific or commercial information from the various devices on the kite and to relay this information to the boat via a cable.

For some situations, a scuba diver is required to visually inspect underwater areas. This can include observation of coral reefs for degradation, and the spread of parasites on a reef. Expensive self-propelled mini submarines are known but these are prohibitively expensive for general use. Submarines also require a high degree of training by users.

Submarines which are self-propelled but non-airtight are also known. In these devices, a person is fitted with a scuba tank, or the submarine has an onboard air system and the submarine is propelled by battery power. Again, this type of submarine is too expensive for normal general use.

Glass bottom boats are well-known and are widely used as a recreation vehicle. However, the glass bottom boats are not suitable when the water depth varies, as resolution loss occurs with an increase in water depth.

A self-propelled pulling device is known where a scuba diver holds on the device to be propelled by it. However, these devices have a fairly limited propelling time and it is difficult to maintain a constant depth over a period of time.

EP 246853 describes a towed underwater sledge which is not water-tight, but which has a lowermost floor pan on which a person is supported. An upright post is positioned between the persons legs to act as a thigh grip post.

Australian patent 270880 describes a non-powered vessel adapted to be towed underwater and includes a streamlined water-tight hull which is capable of carrying within it at least one person in a lying or sitting position.

OBJECT OF THE INVENTION

The present invention is directed to a towable and therefore not self-propelled underwater kite which is non-airtight and on which a person can lie in a substantially horizontal position and where the kite is provided with a steering means, such as a foot operated steering means, to allow the kite to rise and fall while being towed in a desired manner.

It is an object of the invention to provide an underwater kite or underwater towed device which is manned and which may overcome at least part of the abovementioned disadvantages or provide the public with a useful or commercial choice.

In one form, there is provided a towable, non-self-propelled, non-airtight, manned underwater kite which has a main frame which is sized to support a person in a horizontal position, the main frame comprising a pair of spaced apart longitudinal parallel support members and a transverse belt provided between the members for supporting a person lying in a substantially horizontal position between the members, the kite further comprising a front canopy which is in front of the person's head to deflect water away from the person's head, and foot operated elevator steering means adjacent a rear portion of the main frame, which allows the rise and fall of the kite to be controlled.

In a broader form, the invention resides in a towable, non-self-propelled, non-airtight, manned underwater kite which has a main frame which is sized to support a person in a horizontal position, a front canopy which is in front of the persons head and which deflects water away from the persons head, and foot operated elevators, which allow the rise and fall of the kite to be controlled. The elevators can change the angle of attack on the front canopy (leading edge) which in turn drives the kite downward and upward.

The underwater kite is towed by a surface vessel such as a powered dinghy, tug and the like. A suitable rope or cable is used to tow the kite behind the surface vessel. The distance between the kite and the surface vessel can vary to suit but is typically between 30 to 100 m.

The kite has a main frame which is sized to allow a person to be supported thereby in a substantially horizontal position. The frame may be substantially planar and can comprise a pair of spaced apart longitudinal parallel support members, for instance tubes, with the person able to be positioned between the parallel support members. The parallel support members may have a length of between 1.5 to 3 m and a typical length is approximately 2 m. The main frame is typically made from non-corrosive materials which can include plastic pipes.

The kite has a front canopy which is in front of the person's head when the person lies in or on the kite. The front canopy functions to deflect water away from the person's head and can also function as a leading edge as in the wing of a kite which is angle dependent for direction (up or down) of the kite. The person typically wears a face mask and when being towed through water, the canopy functions to reduce the force of water pushing up against the person's head or face. The canopy typically extends across the main frame and is preferably the leading part of the kite. The canopy may be formed from transparent material to allow a person to see through the canopy and in front of the kite.

The kite has foot operated elevators adjacent a rear portion of the main frame and which allows the rise and fall of the kite to be controlled. The foot operated elevators may include a pair of extending fins or vanes extending from each side of the main frame. The fins are typically pivotable and pivoting of the fins causes the kite to raise and lower in the water. The fins can be attached to a foot bar assembly which can be pushed by the person's foot or feet in such a manner that the fins can be pivoted in either direction. The foot bar assembly may comprise spaced apart upper and lower bars whereby pushing of one bar causes the fins to pivot in one direction and pushing of the other bar causes the fins to pivot in the opposite direction. This arrangement is reliable and robust.

The main frame may include a transverse member to assist in supporting a person lying in the horizontal position. The transverse member typically extends across the main frame at about the chest to hip portion of the person. The transverse member may comprise a belt or other flexible sheet-like member on which the person can be supported. A number of spaced apart transverse members or belts may be provided if necessary and it is envisaged that a webbing or other support arrangement may also be used.

The kite may be provided with weights to adjust for the buoyancy. These weights may be fitted to the transverse member and, in one form, the transverse member is a weight belt which has the dual purpose in supporting the person and also providing weight to the kite.

BRIEF DESCRIPTION OF THE DRAWINGS

An embodiment of the invention will be described with reference to the following drawings in which.

BEST MODE

Figure 1:
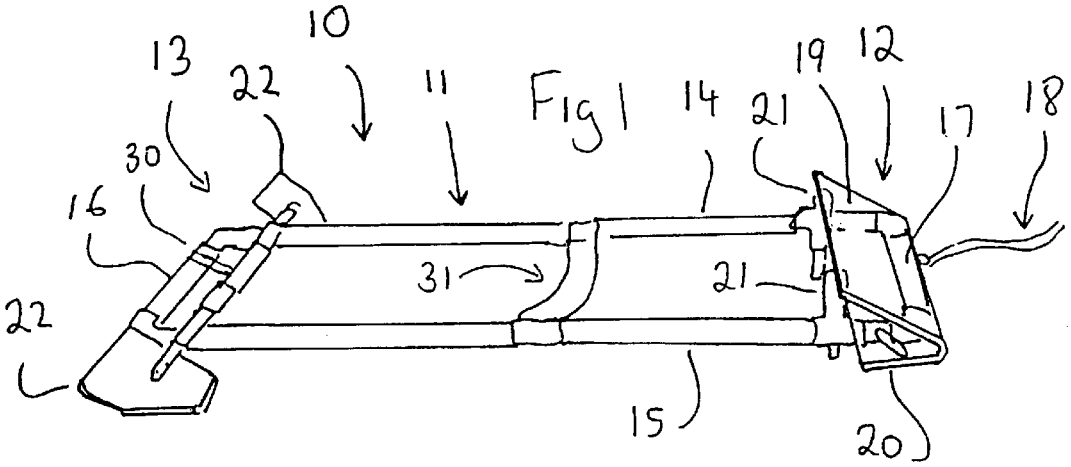
FIG. 1 is a view of an underwater kite according to a first embodiment of the invention.

Referring to the drawings, there is illustrated a towable non-self-propelled, non-airtight underwater kite 10 which is substantially planar and which has a main frame 11 which is sized to allow a person (see FIG. 3) to be supported thereon or thereby in a substantially horizontal position, a front canopy 12 which is in front of the person's head when the person lies on the kite and which deflects water away from the person's head, and foot operated elevators 13 (better illustrated in FIG. 2) and which is adjacent a rear portion of the main frame.

Figure 2:
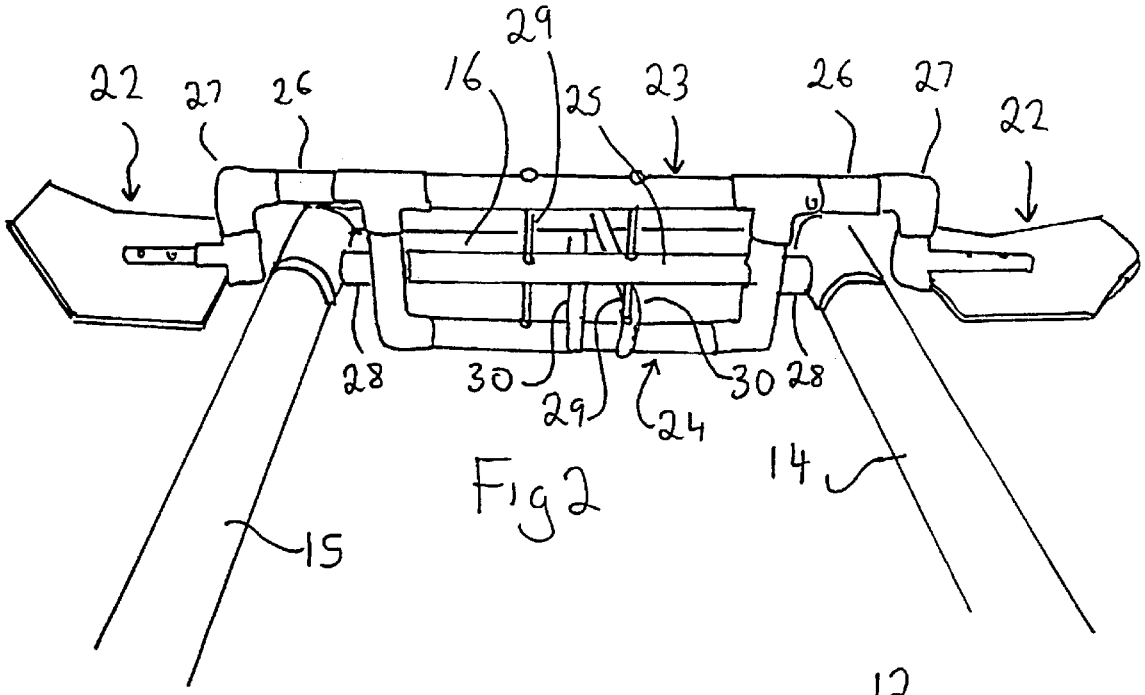
FIG. 2 is a close-up view of the rear foot operated steering means on the kite of FIG. 1.

Referring initially to FIGS. 1 and 2 together, the main frame in the embodiment is formed from two spaced apart longitudinal tubular parallel support members 14, 15 which are formed from plastics tube and which are typically about 2 m long. The tubes are connected by end struts 16, 17 to form a substantially rectangular frame when viewed in plan and a person can be support substantially within this frame as better illustrated in FIG. 3. A tow rope 18 is attached to the kite to allow it to be towed from a tow boat (not illustrated).

Front canopy 12 is formed from transparent acrylic and is substantially V-shaped to provide an upper deflector portion 19 and a lower deflector portion 20. These portions deflect water away from the head of a person lying on the kite, and acts as a leading edge that when its angle of attack is changed, forces the kite up or down.

Just behind canopy 19 are a pair of hand grips 21 which allows a person to grip onto the kite.

The foot operated elevators 13 are better illustrated in FIG. 2, and in the embodiment consists of a pivoting fin 22 extending from each side of the parallel support members 14, 15. Fins 22 can pivot between a substantially horizontal position as illustrated in FIG. 2 and an inclined position which can be an up or down inclined position and which will raise of lower the kite in the water.

Fins 22 are operated by a foot bar assembly which is all formed from glued together plastic pipe members and which consists of a spaced apart upper bar 23, a lower bar 24 and an intermediate bar 25 which are all of approximately the same length and which are all parallel with respect to each other. The top bar 23 has a pair of short extension portions 26 which pass over the top of support members 14, 15 and which through an elbow 27 are attached to fins 22. Intermediate bar 25 forms part of the pivoting or rocking axis and the entire foot bar assembly is pivotally mounted to support bars 14, 15 through pivot pins 28 which can comprise metal pins encased in a plastic tube. The foot bar assembly is held rigidly together by stainless steel rods 29.

To provide a degree of control, the foot bar assembly is attached to strut 16 via an elastic band or cord 30.

It can be seen that a person pushing lower bar 24 will cause fins 22 to incline downwardly while pushing of upper bar 23 will cause fins 22 to include upwardly.

An intermediate transverse belt 31 extends between support members 14, 15 and functions to assist in supporting a person. The belts can be provided with counterweights 32 (see FIG. 3) if desired.

Figure 3:
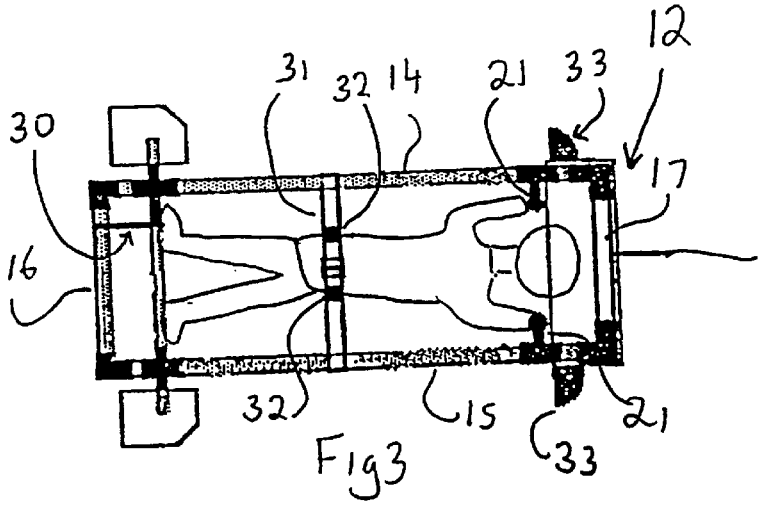
FIG. 3 is a plan view of a kite according to another embodiment of the invention and including forward secondary control fins.

FIG. 3 illustrates an embodiment where a pair of forward secondary control fins 33 are provided on each side of canopy 12 and can be operated by the person to provide a better degree of control.

Figure 4:
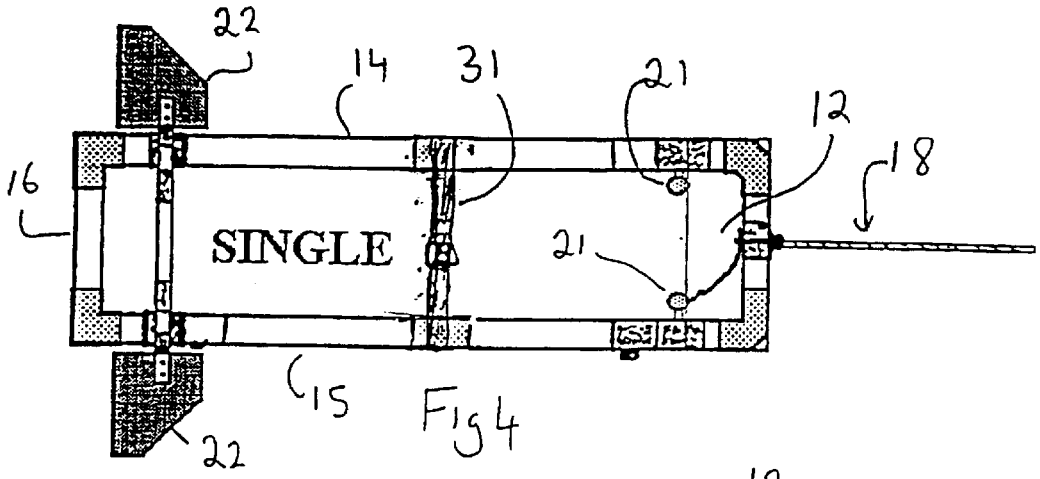
FIGS. 4 and 5 are plan and side views of a kite according to a further embodiment of the invention.
Figure 5:
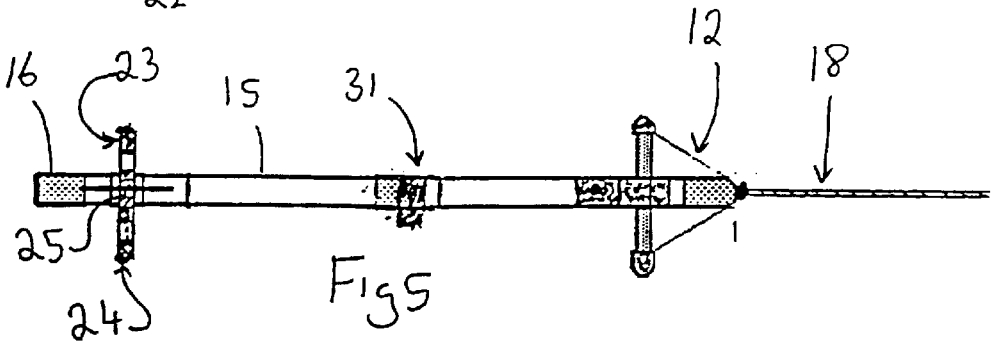

FIGS. 4 and 5 illustrate plan and side views of a kite and like numbers have been used to designate like parts.

Figure 6:
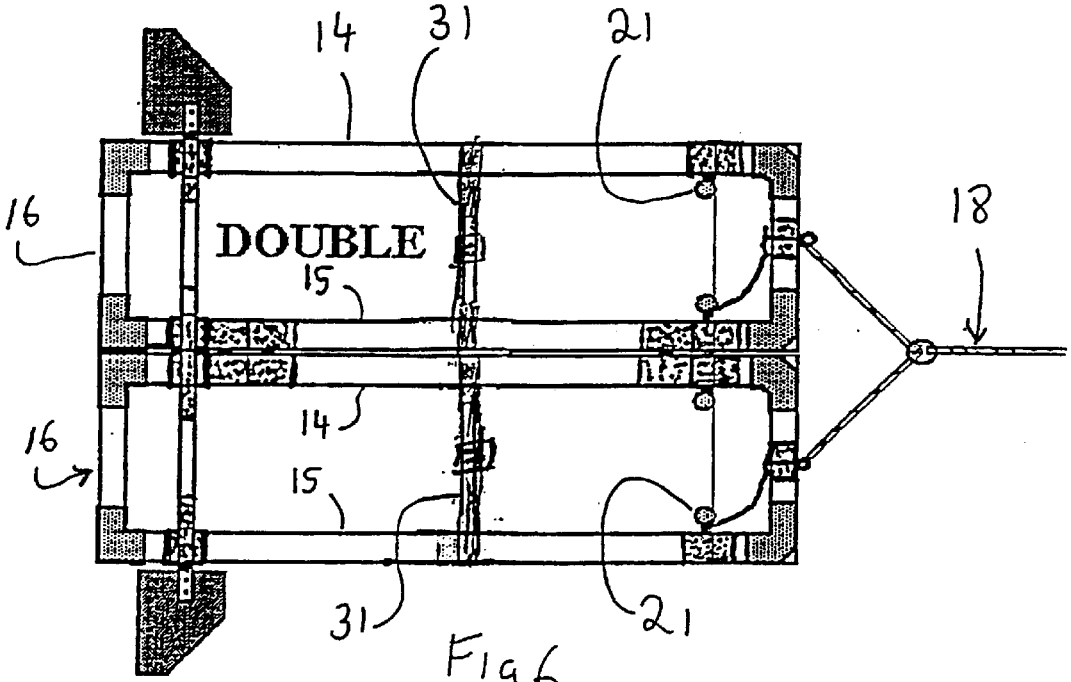
FIG. 6 is a plan view of a two person kite according to an embodiment of the invention.

FIG. 6 illustrates a variation of the invention which is two person kite where, for instance, one person can be purely observing the sea floor, coral or whatever, and the second person can be the controller. In this version, the foot bar assembly is modified such that one of the fins is removed and the foot bar assemblies are connected together by having portion 26 longer than usual to connect to the elbow 27 of the adjacent foot bar assembly.

It should be appreciated that various other changes and modifications can be made to the embodiment described without departing from the spirit and scope of the invention as claimed.

What is claimed is:

1. A towable, non-self-propelled, non-airtight, manned underwater kite which has a main frame which is sized to support a person in a horizontal position, the main frame comprising a pair of spaced apart longitudinal parallel support members and a transverse belt provided between the members for supporting a person lying in a substantially horizontal position between the members, the kite further comprising a front canopy which is in front of the person's head to deflect water away from the person's head, and foot operated elevator steering means adjacent a rear portion of the main frame, which allows the rise and fall of the kite to be controlled.

2. The kite of claim 1, which is substantially planar and wherein the front canopy has an upper and lower deflector to deflect water above and below the kite, the elevator steering means comprising a fin extending from each side of the kite and which is pivotable to raise and lower the kite by changing the angle of attack on the front canopy, the fins being attached to a foot bar assembly which extends between the support members, the foot bar assembly comprising a spaced apart upper bar and lower bar , whereby pushing of one bar causes the fins to pivot in one direction and pushing of the other bar causes the fins to pivot in the opposite direction.

3. The kite of claim 2, wherein the parallel support members have a length of between 1.5 to 3 m.

4. The kite of claim 3, wherein the canopy is formed from transparent material.

5. The kite of claim 4, wherein a plurality of spaced apart said transverse belts are provided.

6. The kite of claim 1, wherein the transverse belt comprises a webbing.

7. The kite of claim 4, wherein weights are provided to adjust for buoyancy.

8. The kite of claim 7, wherein the weights are fitted to the transverse member.

9. A towable, non-self-propelled, non-airtight, manned underwater kite which has a main frame which is sized to support a person in a horizontal position, a front canopy which is in front of the persons head and to deflect water away from the persons head, and foot operated elevator means steering means adjacent a rear portion of the main frame, which allows the rise and fall of the kite to be controlled.

10. The kite of claim 9, which is substantially planar and wherein the main frame comprises a pair of spaced apart longitudinal parallel support members, a transverse belt being provided between the members and which is to support a person lying in a substantially horizontal position between the members, the front canopy having an upper and lower deflector to deflect water above and below the kite, the elevator comprising a fin extending from each side of the kite and which is pivotable to raise and lower the kite, the fins being attached to a foot bar assembly which extends between the support members, the foot bar assembly comprising a spaced apart upper bar and lower bar, whereby pushing of one bar causes the fins to pivot in one direction and pushing of the other bar causes the fins to pivot in the opposite direction.

* * * * *